United States Patent [19]

Kimura et al.

[11] Patent Number: 4,928,034

[45] Date of Patent: May 22, 1990

[54] IMPREGNATED CATHODE

[75] Inventors: Sakae Kimura, Tokyo; Masaru Nikaido; Katumi Yanagibashi, both of Yokohama; Katsuhisa Homma, Kawasaki; Yoshiaki Ouchi, Yokohama, all of Japan

[73] Assignee: Kabushiki Kaisha Toshiba, Kawasaki, Japan

[21] Appl. No.: 273,157

[22] Filed: Nov. 18, 1988

Related U.S. Application Data

[63] Continuation of Ser. No. 58,362, Jun. 4, 1987, abandoned.

[30] Foreign Application Priority Data

Jun. 6, 1986 [JP] Japan ..... 61-130223
Jun. 6, 1986 [JP] Japan ..... 61-130224

[51] Int. Cl.[5] ..... H01J 1/14

[52] U.S. Cl. ..... 313/346 R; 313/346 DC; 313/366; 313/338; 313/337

[58] Field of Search ..... 313/336, 337, 338, 346 R, 313/346 DC, 366; 252/514, 515

[56] References Cited

U.S. PATENT DOCUMENTS 4,165,473 8/1979 Falce ..... 313/346 D
4,208,208 6/1980 Misumi et al. ..... 313/346 R
4,417,173 11/1983 Tuck et al. ..... 313/346 D
4,518,890 5/1985 Taguchi et al. ..... 313/346 R
4,675,570 6/1987 Green ..... 313/346 R

FOREIGN PATENT DOCUMENTS 60-68527 4/1985 Japan .
60-138822 7/1985 Japan .

OTHER PUBLICATIONS

Extended Abstract of the 32nd Spring Meeting of the Japan Socient of Applied Physics & Related Societies 29P-R-3-, M. Nikaido et al; Mar. 29, 1985.

*Primary Examiner*—Leo H. Boudreau
*Assistant Examiner*—Michael Razavi
*Attorney, Agent, or Firm*—Cushman, Darby & Cushman

[57] ABSTRACT

According to the present invention, an impregnated cathode is provided wherein an alloy layer of iridium and tungsten is formed on a surface of a porous pellet impregnated with an oxide of an alkali earth metal, wherein a crystal structure of the alloy has an $\epsilon$II phase comprising an hcp structure whose lattice constants a and c satisfy $2.76 \leqq a \leqq 2.78$ and $4.44 \leqq c \leqq 4.46$, respectively. The impregnated cathode of the present invention maintains stable electron emission characteristics from an early stage of operation.

3 Claims, 6 Drawing Sheets

IMPREGNATED CATHODE

This is a continuation of application Ser. No. 058,362, filed June 4, 1987, which was abandoned upon the filing hereof.

BACKGROUND OF THE INVENTION

The present invention relates to an impregnated cathode used in an electron tube or the like and, more particularly, to a surface coating layer thereof, used for thermionic emission An impregnated cathode is obtained by impregnating pores of a porous pellet with an electron-emission material such as barium oxide, calcium oxide, aluminum oxide, etc. Such a cathode can provide a current density higher than a conventional oxide thermal cathode, and has a longer service life, since it is resistant to a harmful gas, contained in a tube, and which interferes with electron emission. Consequently, cathodes of this type are employed in a travelling-wave tube used in, for example, artificial satellites, in a high-power klystron used for plasma heating in a nuclear fusion reactor, etc.

In the above fields, high reliability (long service life, stable operation, and so on) and high current density are required of a cathode. As a means of increasing the reliability, a layer of an element of the platinum group, such as iridium, osmium, ruthenium, etc. or an alloy thereof, is coated on the cathode surface, in order to decrease the work function of the cathode surface, thereby to decrease the operating temperature In contrast to a case wherein such a coating layer is not provided, the operating temperature of a cathode having a coating layer can be decreased by several tens to one hundred and several tens °C., to obtain the same current density. Since evaporation of the electron emission material can then be limited, this is advantageous for a cathode, with regard to prolongation of its service life, and provides an improvement in the intratube withstand voltage characteristics.

However, the operating temperature in this case is still as high as 900° to 1,000° C. Therefore, W for forming a pellet is diffused in the surface coating layer during operation, and forms an alloy together with a metal constituting the surface coating layer. Alloying of the surface coating layer changes the electron-emission characteristics, and interferes with the achieving of stable characteristics from an early stage of operation, and with the prolongation of the service life.

SUMMARY OF THE INVENTION

The present invention has as its object to provide an impregnated cathode which maintains stable electron emission characteristics from the early stage of operation, and a method of manufacturing the same.

The present invention provides an impregnated cathode wherein an alloy layer of iridium and tungsten is formed on a surface of a porous pellet impregnated with an oxide of an alkali earth metal, wherein the crystal structure of the alloy has an $\epsilon$II phase comprising an hcp (hexagonal close-packed) structure whose lattice constants a and c satisfy $2.76 \leqq a \leqq 2.78$ and $4.44 \leqq c \leqq 4.46$. When this impregnated cathode is manufactured, a layer of iridium is coated on the surface of the porous pellet. Then, the porous pellet is heated in a vacuum or inert atmosphere at 1,100° to 1,260° C., for a predetermined period of time.

The heating process of the present invention is considerably practical, since it has a good reproducibility. The appropriate thickness of the Ir coating layer is 50 to 10,000 Å, because of the ease in controlling the heating time, and in order to preserve the electron emission characteristics of the pellet. The thickness of the alloy layer is about twice that of the Ir coating layer, as will be described later. However, when the alloy layer is thinner than 100 Å, the service life of the cathode is decreased; when it is thicker than 20,000 Å, it is necessary for the operating temperature to remain high.

The heating time in this case is arbitrarily determined within the range of 1 to 360 minutes. If the heating temperature is higher than 1,260° C., the amount of electron emission material evaporating from the pellet is excessive, thereby degrading electron emission characteristics. When the heating temperature is 1,100° C. or lower, an extended period of time is required for alloying of the $\epsilon_{II}$ phase; therefore, this is impractical.

Alternatively, an alloy layer of $\epsilon$II phase of iridium and tungsten, can be used as the coating layer, in place of the iridium layer.

DETAILED DESCRIPTION OF THE INVENTION

An Ir layer having a thickness of 3500 Å was coated on a porous pellet, and the change in the crystal structure in the surface layer of the Ir-coated porous pellet was measured in situ using a vacuum high-temperature X-ray diffractometer. When the change in the X-ray diffraction pattern was observed along the heating schedule of the cathode shown in FIG. 2, it was confirmed that the change was as shown in FIG. 3.

Figure 3:
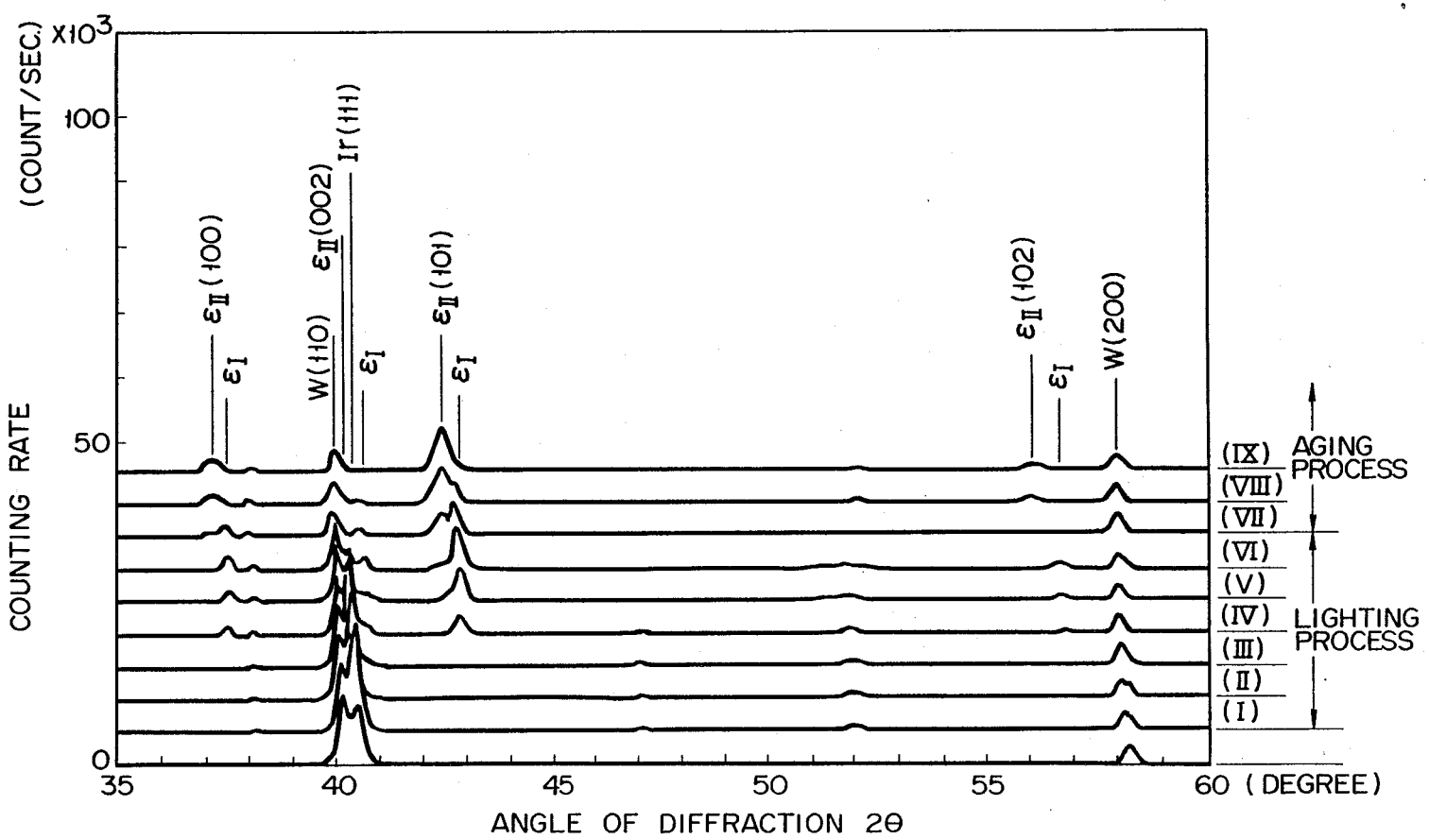
FIG. 3 shows X-ray diffraction pattern of the cathode surface in the respective processes shown in FIG. 2.

It is seen in FIG. 3 that the $\epsilon$ phase of the intermetallic compound of Ir and W appears after the lighting process (IV). The $\epsilon$ phase has an hcp structure. In the aging process, a series of diffraction peaks exhibiting the same crystal type appeared on the low-angle sides of the respective diffraction peaks of $\epsilon$ phase. As the aging process proceeds, the peaks that appeared in the lighting process disappeared and were replaced by the pattern that appeared in the aging process. The $\epsilon$ phase which appeared in the lighting process will be referred to as $\epsilon$I phase and the phase that appeared in the aging process will be referred to as $\epsilon$II phase. The discrete changes in the diffraction pattern from $\epsilon$I to $\epsilon$II phase correspond to the discrete changes in the lattice constants a and c. Namely, $2.735 \leqq a \leqq 2.745$ Å and $4.385 \leqq c \leqq 4.395$ Å were obtained in εI phase, whereas $2.760 \leqq a \leqq 2.780$ Å and $4.440 \leqq c \leqq 4.460$ Å were obtained in εII phase.

Figure 4:
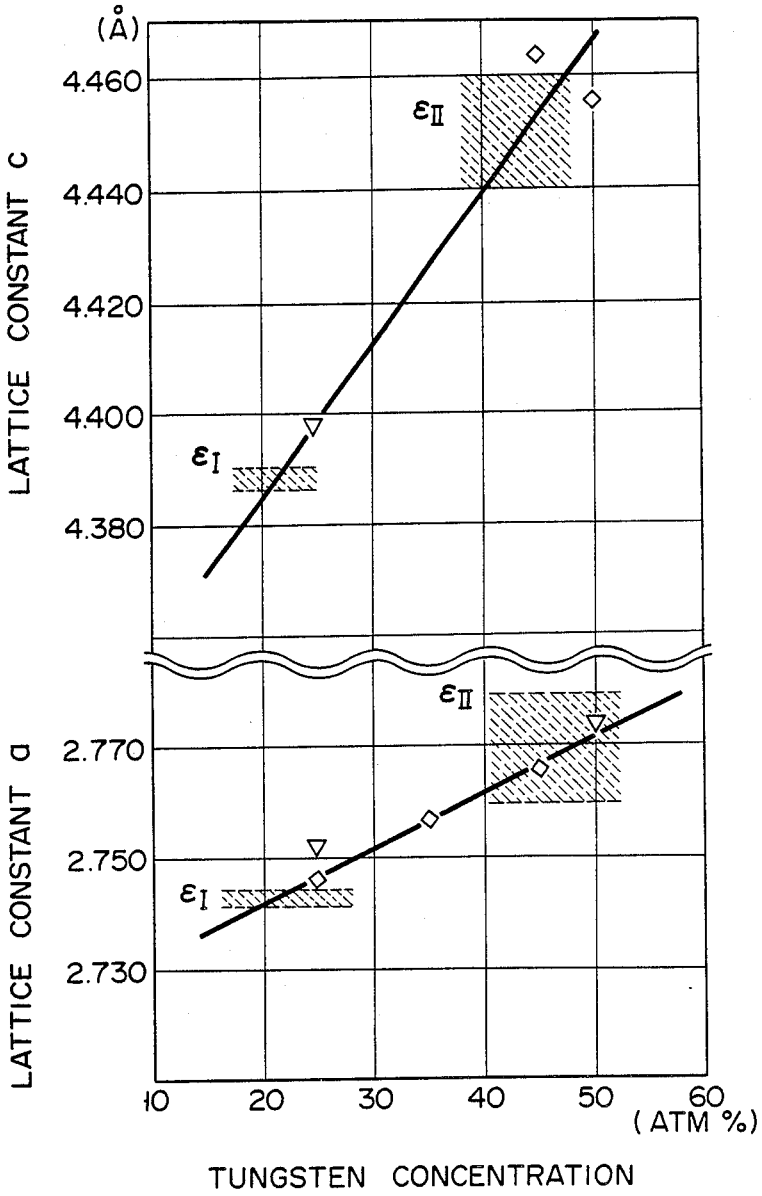
FIG. 4 shows a graph comparing $\epsilon$I phase and $\epsilon$II phase.

The relationship between these values of lattice constants a and c and the W concentration in the Ir-W alloy has already been reported. This relationship is indicated by solid lines in FIG. 4. Dotted lines indicate the values of the lattice constants of the εI and εII phases obtained by the experiments conducted by the present inventors. The corresponding W concentrations are about 20 to 25 atm % in εI phase and about 40 to 50 atm % in εII phase. It is seen in FIG. 4 that the change in the composition of the surface layer occurs quite discretely by the transition from εI to εII phase. εII phase exhibited a considerably stable crystal structure. Its lattice constants did not substantially change in the subsequent heating process.

Figure 5A:
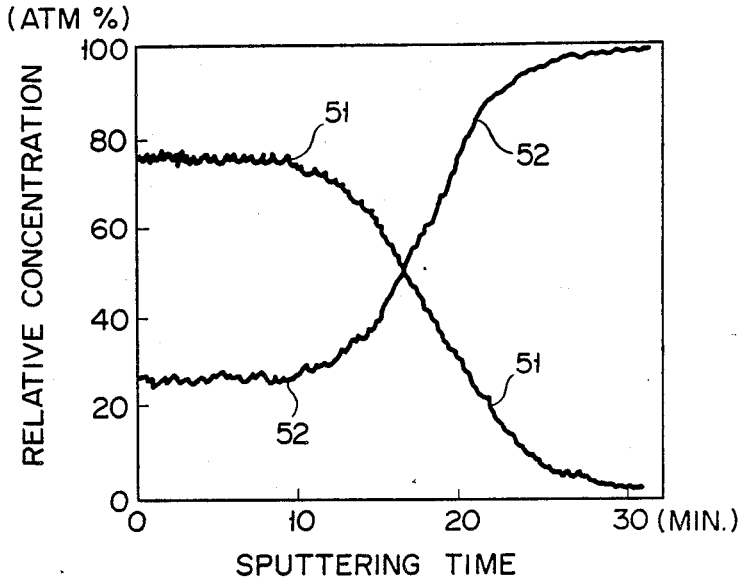
FIGS. 5A and 5B show graphs of relative concentrations of W and Ir after lighting and aging processes are completed, respectively.
Figure 5B:
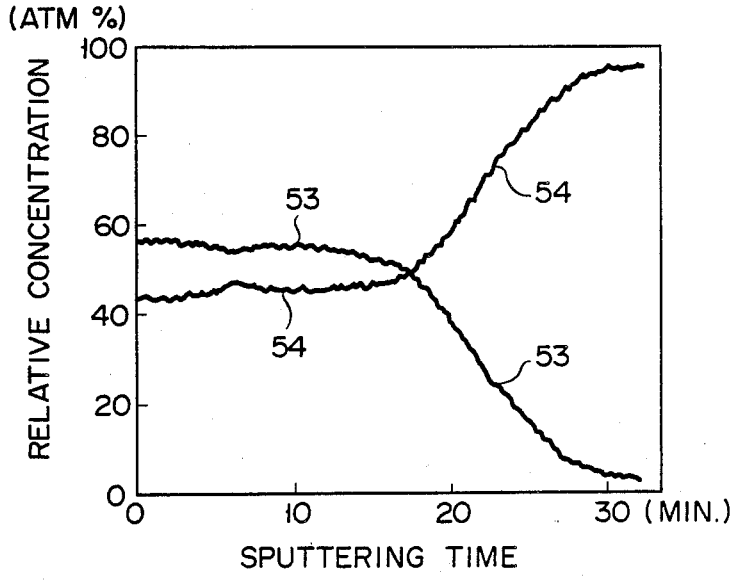

The compositions of the alloy layers after the lighting and aging processes were analyzed by sputtering from the surface in the direction of depth (indicated by a corresponding sputtering time) with an Auger electron spectroscope, and the results shown in FIGS. 5A and 5B were obtained. FIGS. 5A and 5B show relative concentration profiles after lighting and aging processes, respectively. Curves 51 and 53 indicate relative iridium concentrations, and curves 52 and 54 indicate relative tungsten concentrations. It is seen that, in the alloy layer after completion of the lighting process, tungsten was quickly diffused in iridium since the tungsten concentration gradient near the surface was small. The tungsten concentration near the surface was about 25 atm %. In the alloy layer after completion of the aging process, the tungsten concentration in the surface and in the layer is 40 to 50 atm %. These facts coincide with the results of changes in the composition in the surface coating layer shown in FIG. 4.

Figure 6:
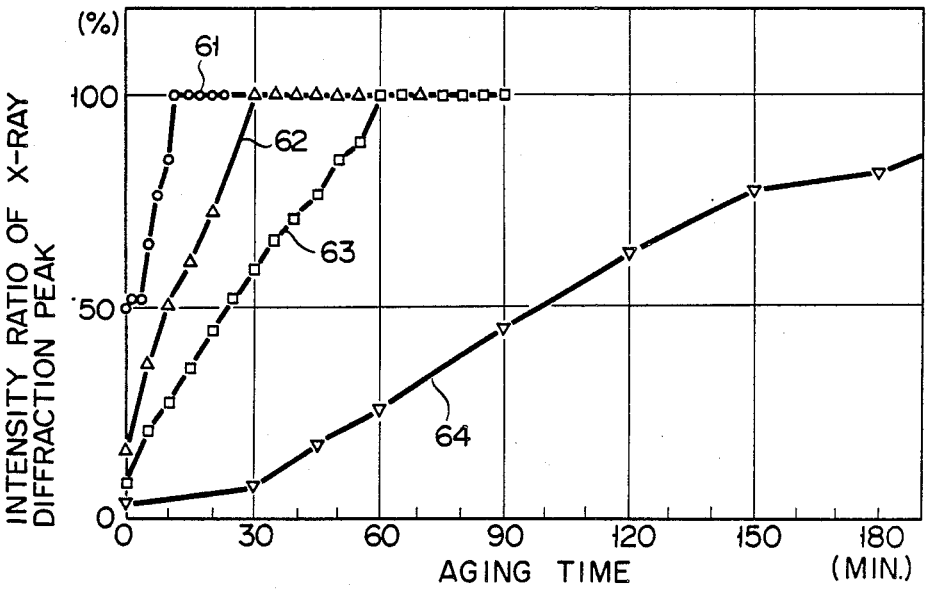
FIG. 6 shows a graph indicating a relationship between the aging time and the intensity ratio of the X-ray diffraction peak.

The relationship between the thickness of the iridium layer and the aging conditions was studied. FIG. 6 shows the results obtained by X-ray diffraction. The X-ray diffraction intensity ratios plotted along the axis of ordinate are ratios of the εII phase diffraction peak intensities to the sum of the diffraction peak intensities of Ir layer, εI and εII phases. Curves 61, 62, 63, and 64 indicate ratios when the thicknesses of the iridium coating layers are 1,000, 2,000, 3,500, and 5,000 Å, respectively. The heating temperature was 1,180° C.

It is seen in FIG. 6 that the aging time required for the transition from εI to εII phase depends on the thickness of the Ir coating layer and that the thicker the Ir layer, the longer the εII phase formation time. Therefore, when the aging time is set constant, in order to form a perfect εII phase, the thicker the Ir coating layer, the higher the heating temperature.

Figure 7:
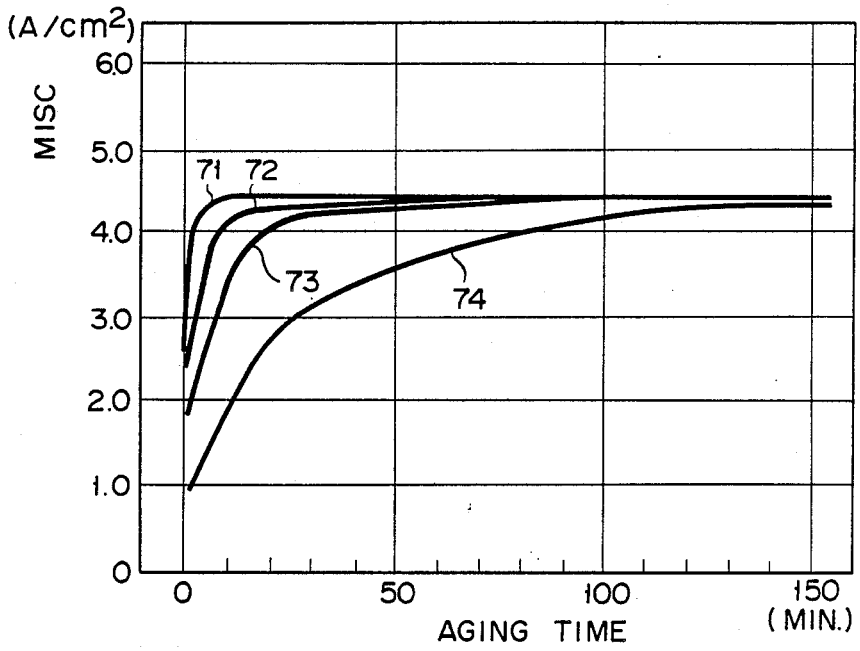
FIG. 7 shows a graph indicating a relationship between the aging time and MISC.

FIG. 7 shows a change in the maximum emission value in a space charge limiting region, i.e., MISC (Maximum $I_k$ Saturated Current) with respect to the aging time for each Ir layer thickness. Curves 71, 72, 73, and 74 indicate MISC's when the thicknesses of the Ir coating layers are 1,000, 2,000, 3,500, and 5,000 Å, respectively. An MISC is a value measured 1 second after the start of an anode voltage application. It is seen from these results that the thicker the Ir coating layer, the less the increase in MISC, and that a longer heating time is required to activate emission.

The electron emission characteristics of MISC were measured in a plane-parallel diode glass dummy tube. During measurement of the electron emission characteristics, the cathode temperature was decreased to 1,000° C. so that aging did not proceed.

It is also apparent from FIGS. 5 to 7 that the electron emission characteristics are closely related to the formation ratio of εII phase, and that a stable, maximum electron emission current can be obtained when the εII phase is completely formed in the surface of the alloy layer.

Figure 8:
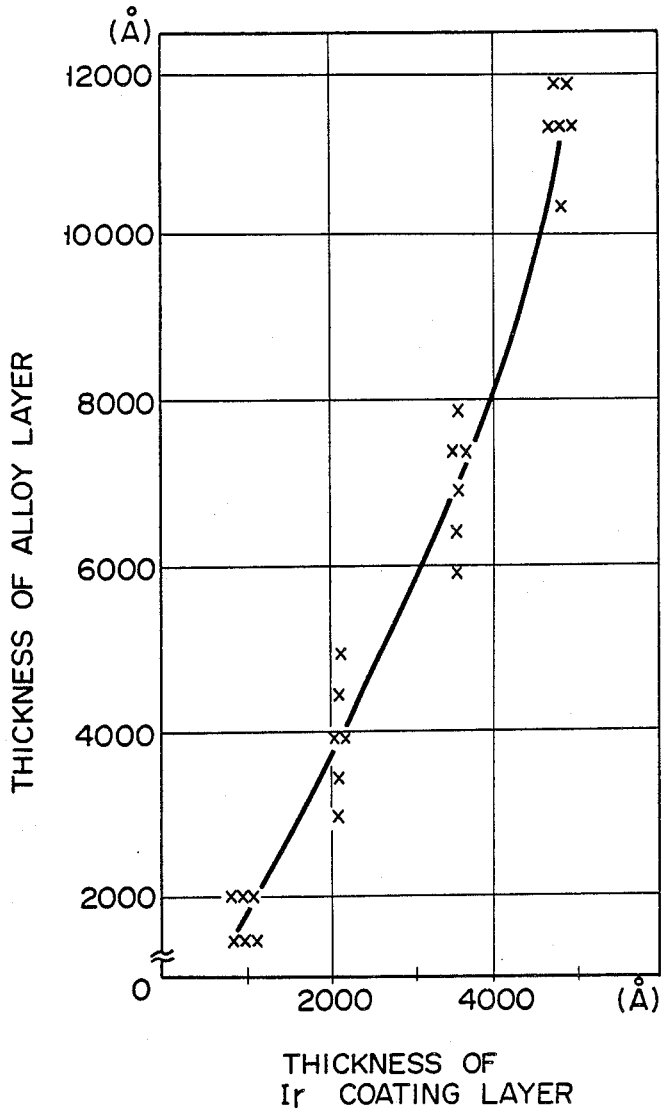
FIG. 8 shows a graph indicating the relationship between the thickness of the Ir coating layer and the alloy layer.

Finally, the section of the cathode after alloying was observed by a scanning electron microscope to examine the relationship between the thickness of the alloy layer and thickness of the Ir coating layer. FIG. 8 shows its result. It is seen in FIG. 8 that the thickness of the alloy layer formed is about twice that of the thickness of the Ir layer before the heating process.

DETAILED DESCRIPTION OF THE PREFERRED EMBODIMENTS

EXAMPLE 1

A mixture of barium oxide, calcium oxide, and aluminum oxide (in a molar ratio of about 4:1:1) was melted and impregnated in a porous tungsten pellet having a diameter of 1.5 mm, a thickness of 0.4 mm, and a porosity of about 20%. The surface of the pellet was cleaned to remove excessive Ba, thereby forming impregnated pellet 11 shown in FIG. 1. Subsequently, pellet 11 was welded to tantalum cup 13 having a thickness of 25 μm through rhenium wire 15. Cup 13 was welded to an opening at one end of tantalum support sleeve 17. Sleeve 17 was fixed to a support cylinder (not shown) through three support straps of a rheniummolybdenum alloy, thereby forming a cathode. An Ir layer having a thickness of 3,500 Å was formed by sputtering on the surface of pellet 11.

Figure 2:
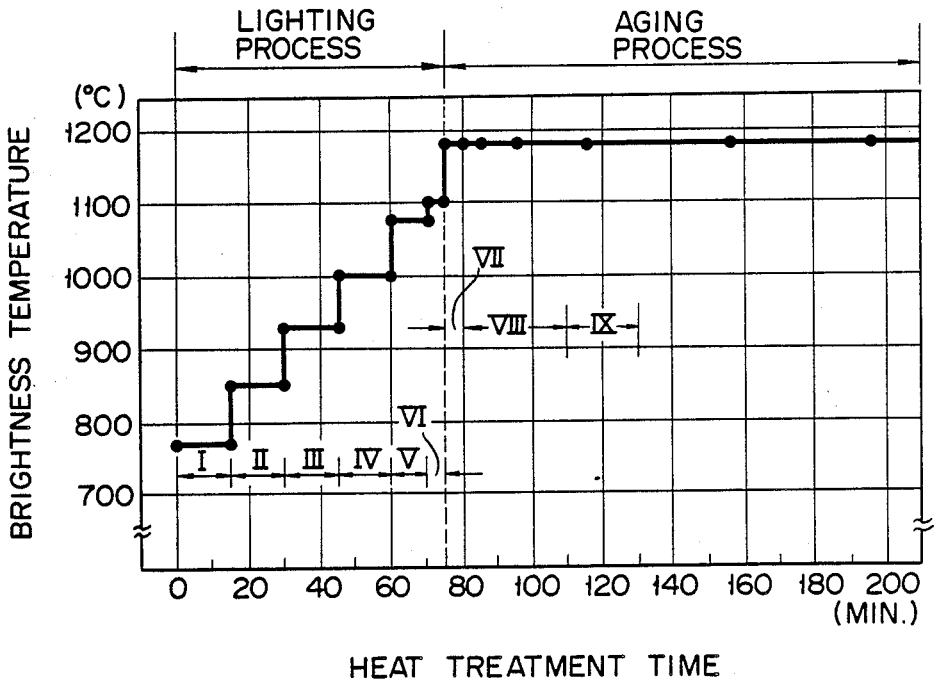
FIG. 2 is a graph showing the time and temperature in each heating process of Example 1 of the present invention.

The cathode was placed in a vacuum bell jar evacuated to $10^{-7}$ Torr or less. A heater (not shown) was powered to heat the cathode at a predetermined temperature for a predetermined period of time. FIG. 2 shows the time and temperature in this heating process. The heating process consists of a lighting process (I, II, III, IV, V, and VI) for gradually heating the cathode for the purpose of degassing, and an aging process (VII, VIII, and IX) for heating the cathode at a constant temperature of a brightness temperature of about 1,180° C. for a predetermined period of time. The brightness temperature was that of the cathode surface measured with a optical eyrometer with 650 nm filter.

In this manner, Ir-W alloy coating layer 19 of ε phase having an hcp structure wherein the lattice constants a and c (unit: Å) satisfy $2.76 \leqq a \leqq 2.78$ and $4.44 \leqq c \leqq 4.46$ was formed. This impregnated cathode was incorporated in a travelling-wave tube for an artificial satellite and was started. Electron emission characteristics having a considerably excellent stability were obtained even after a lapse of a long time from the initial stage of operation.

EXAMPLES 2-20

Samples obtained by coating Ir layers to thicknesses of 50 to 10,000 Å on the surfaces of porous pellets by sputtering were prepared and were subjected to predetermined heating. This surface alloying treatment was practiced by two methods; an inside-the-tube heating method to assemble a cathode in an electron tube, that uses this cathode, and energize the heater in the cathode; and a single body heating method to heat the cathode in a vacuum bell jar before assembly in an election tube. The inside-the-tube heating method is suitable for a comparatively low-voltage electron tube or the like, and the single body heating method is suitable for a large or high-voltage electron tube or the like.

Figure 1:
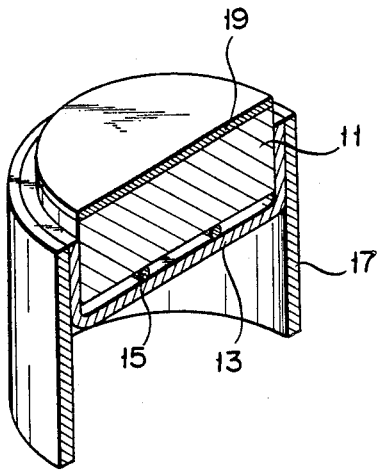
FIG. 1 is a perspective view of part of an impregnated cathode according to the present invention.

A cathode shown in FIG. 1 was formed by using each of these samples, and the following tests were conducted. A change in electron-emitting current value was measured at an operating temperature of 1,000° C. and under an anode voltage wherein the initial emitting current density was 0.8 A/cm$^2$ in the space charge limiting region. The ratios of the electron-emitting current values immediately after the start of operation and 3,000 hours after the start to the electron-emitting current value 100 hours after the start of the operation test were respectively evaluated as the initial and service life characteristics. Table 1 shows the result. Reference symbols x, Δ, ○, and ◎ indicate the cases wherein the above ratios were 59% or less, 60 to 79%, 80 to 89%, and 90 to 100%, respectively. The closer to 100%, the more superior the electron-emitting characteristics.

In Table 1, cathodes in which the εII phase was observed substantially in the entire portions of their alloy layers are grouped as Examples, and cathodes in which the εI phase only or both the εI and εII phases were observed in their alloy layers are grouped as Controls.

TABLE 1

| Sample No. | Thickness of Ir Coating Layer (Å) | Alloying Method: Heating Method | Alloying Method: Condition (°C., hr(s)) | Crystal structure of alloy | Initial Characteristics | Service life Characteristics |
|---|---|---|---|---|---|---|
| Control 1 | 49 | Inside Tube | 1000, 1 | εI | ○ | x |
| Example 2 | 48 | Inside Tube | 1100, 1 | εII | ○ | ○ |
| Example 3 | 53 | Inside Tube | 1180, 1 | εII | ◎ | ○ |
| Control 2 | 495 | Inside Tube | 1100, 5 | εI, εII | Δ | Δ |
| Control 3 | 498 | Inside Tube | 1100, 5 | εI, εII | Δ | Δ |
| Example 4 | 503 | Inside Tube | 1180, 5 | εII | ○ | ○ |
| Control 4 | 988 | Inside Tube | 1100, 10 | εI, εII | Δ | Δ |
| Control 5 | 995 | Inside Tube | 1180, 5 | εI, εII | Δ | Δ |
| Example 5 | 997 | Inside Tube | 1180, 10 | εII | ○ | ○ |
| Example 6 | 1003 | Single Member | 1180, 10 | εII | ◎ | ○ |
| Example 7 | 1005 | Single Member | 1180, 30 | εII | ◎ | ◎ |
| Control 6 | 1988 | Inside Tube | 1100, 60 | εI, εII | Δ | x |
| Example 8 | 1993 | Inside Tube | 1100, 150 | εII | ○ | ○ |
| Example 9 | 1995 | Inside Tube | 1100, 300 | εII | ◎ | ○ |
| Example 10 | 2002 | Single Member | 1180, 30 | εII | ◎ | ○ |
| Example 11 | 2005 | Single Member | 1180, 60 | εII | ◎ | ◎ |
| Control 7 | 3490 | Inside Tube | 1100, 60 | εI, εII | Δ | Δ |
| Control 8 | 3496 | Inside Tube | 1100, 120 | εI, εII | Δ | Δ |
| Example 12 | 3501 | Single Member | 1180, 60 | εII | ○ | ○ |
| Example 13 | 3505 | Single Member | 1180, 120 | εII | ◎ | ◎ |
| Example 14 | 3507 | Single Member | 1250, 120 | εII | ◎ | ◎ |
| Control 9 | 4987 | Inside Tube | 1100, 60 | εI, εII | x | x |
| Control 10 | 4995 | Inside Tube | 1100, 120 | εI, εII | x | Δ |
| Control 11 | 5012 | Single Member | 1180, 120 | εI, εII | Δ | Δ |
| Example 15 | 5020 | Single Member | 1180, 180 | εII | ◎ | ○ |
| Example 16 | 5023 | Single Member | 1180, 240 | εII | ◎ | ◎ |
| Control 12 | 7444 | Single Member | 1100, 120 | εI, εII | x | x |
| Control 13 | 7456 | Single Member | 1100, 180 | εI, εII | x | x |
| Control 14 | 7459 | Single Member | 1180, 360 | εII | ○ | ○ |
| Example 17 | 7480 | Single Member | 1220, 180 | εII | ○ | ○ |
| Example 18 | 7490 | Single | 1260, 180 | εII | ◎ | ◎ |

TABLE 1-continued

| Sample No. | Thickness of Ir Coating Layer (Å) | Alloying Method: Heating Method | Alloying Method: Condition (°C., hr(s)) | Crystal structure of alloy | Initial Characteristics | Service life Characteristics |
|---|---|---|---|---|---|---|
| Control 15 | 9958 | Member Single Member | 1180, 180 | εI, εII | Δ | x |
| Example 19 | 9970 | Member Single Member | 1180, 240 | εII | ○ | ○ |
| Example 20 | 10046 | Member Single Member | 1260, 240 | εII | ○ | ○ |

It is apparent from Table 1 that, when the heating conditions are changed in accordance with the thickness of the Ir layer to be coated first and the εII phase is formed on the entire surface of the alloy phase, stable electron emission characteristics that last for a long period of time from the early stage of operation can be obtained.

What is claimed is:

1. An impregnated cathode, having stable electron emission characteristics at an early stage of operation and prolonged service life comprising:

(a) a porous pellet substrate consisting of a tungsten matrix impregnated with at least one alkaline earth oxide; and (b) a continuous surface layer consisting of an alloy of iridium and tungsten having a thickness of 100 to 20,000 Å formed on an upper surface of said pellet substrate, wherein a crystal structure of said alloy has an $\epsilon_{II}$ phase, comprising an hexagonal close-packed structure, with lattice constants of $2.76 \leqq a \leqq 2.78$ and $4.44 \leqq c \leqq 4.46$, wherein said stable electron emission characteristics are related to said lattice constants of said $\epsilon_{II}$ phase.

2. A process for manufacturing an impregnated cathode, having stable electron emission characteristics at an early stage of operation and a prolonged service life comprising the steps of:

(a) impregnating a porous pellet substrate consisting of a tungsten matrix, with at least one molten alkaline earth oxide;

(b) coating an upper surface of said porous pellet substrate with an iridium layer; and (c) heating said iridium coated pellet substrate in a vacuum or an inert atmosphere at 1,100° C. to 1,260° C. for a predetermined period of time, wherein tungsten from said tungsten matrix migrates into said iridium layer to produce a tungsten-iridium coated pellet substrate.

3. A method according to claim 2, wherein said predetermined period of time is 1 to 360 minutes.

* * * * *